US006980179B2

(12) United States Patent
Yatsuda et al.

(10) Patent No.: US 6,980,179 B2
(45) Date of Patent: Dec. 27, 2005

(54) DISPLAY DEVICE AND PLASMA DISPLAY APPARATUS

(75) Inventors: Norio Yatsuda, Kawasaki (JP); Takashi Sasaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/361,502

(22) Filed: Feb. 11, 2003

(65) Prior Publication Data

US 2003/0193487 A1 Oct. 16, 2003

(30) Foreign Application Priority Data

Apr. 15, 2002 (JP) ..... 2002-111741

(51) Int. Cl.[7] ..... G09G 3/28; G09G 3/10; H01J 1/62

(52) U.S. Cl. ..... 345/63; 345/67; 313/505; 315/169.4

(58) Field of Search ..... 345/63, 67, 72, 345/60, 55, 77; 313/505, 491, 585, 582, 584; 315/169.4, 169.3

(56) References Cited

U.S. PATENT DOCUMENTS 6,326,981 B1 12/2001 Mori et al. ..... 345/695
6,424,095 B1 * 7/2002 Hirao et al. ..... 315/169.4
6,549,180 B1 * 4/2003 Yoo et al. ..... 345/60

FOREIGN PATENT DOCUMENTS

JP 2000-100333 4/2000
JP 2000-100333 * 4/2004

* cited by examiner

*Primary Examiner*—Tuyet Thi Vo
(74) *Attorney, Agent, or Firm*—Staas & Halsey LLP

(57) ABSTRACT

A display device is provided in which the number of gradation levels in a display is increased without increasing the number of terminals of a driving device. A display block of one pixel in an image display screen including a plurality of cells are provided with M (two or more) cells having the same light color, and the structures of these cells are made different partially from each other, so that (M+1) types of light emission quantity control including non-light emission can be performed.

19 Claims, 13 Drawing Sheets

FIG. 8

| | LUMINANCE WEIGHT | | | ADDRESS VOLTAGE LEVEL | | |
|---|---|---|---|---|---|---|
| | SF1 | SF2 | SF3 | SF1 | SF2 | SF3 |
| GRADATION LEVEL0 | 0 | 0 | 0 | 0 | 0 | 0 |
| GRADATION LEVEL1 | 1 | 0 | 0 | L | 0 | 0 |
| GRADATION LEVEL2 | 2 | 0 | 0 | H | 0 | 0 |
| GRADATION LEVEL3 | 0 | 3 | 0 | 0 | L | 0 |
| GRADATION LEVEL4 | 1 | 3 | 0 | L | L | 0 |
| GRADATION LEVEL5 | 2 | 3 | 0 | H | L | 0 |
| GRADATION LEVEL6 | 0 | 6 | 0 | 0 | H | 0 |
| GRADATION LEVEL7 | 1 | 6 | 0 | L | H | 0 |
| GRADATION LEVEL8 | 2 | 6 | 0 | H | H | 0 |
| GRADATION LEVEL9 | 0 | 0 | 9 | 0 | 0 | L |
| GRADATION LEVEL10 | 1 | 0 | 9 | L | 0 | L |
| GRADATION LEVEL11 | 2 | 0 | 9 | H | 0 | L |
| GRADATION LEVEL12 | 0 | 3 | 9 | 0 | L | L |
| GRADATION LEVEL13 | 1 | 3 | 9 | L | L | L |
| GRADATION LEVEL14 | 2 | 3 | 9 | H | L | L |
| GRADATION LEVEL15 | 0 | 6 | 9 | 0 | H | L |
| GRADATION LEVEL16 | 1 | 6 | 9 | L | H | L |
| GRADATION LEVEL17 | 2 | 6 | 9 | H | H | L |
| GRADATION LEVEL18 | 0 | 0 | 18 | 0 | 0 | H |
| GRADATION LEVEL19 | 1 | 0 | 18 | L | 0 | H |
| GRADATION LEVEL20 | 2 | 0 | 18 | H | 0 | H |
| GRADATION LEVEL21 | 0 | 3 | 18 | 0 | L | H |
| GRADATION LEVEL22 | 1 | 3 | 18 | L | L | H |
| GRADATION LEVEL23 | 2 | 3 | 18 | H | L | H |
| GRADATION LEVEL24 | 0 | 6 | 18 | 0 | H | H |
| GRADATION LEVEL25 | 1 | 6 | 18 | L | H | H |
| GRADATION LEVEL26 | 2 | 6 | 18 | H | H | H |

| | LUMINANCE WEIGHT | | | LIGHT (1) / NON-LIGHT (0) | | |
|---|---|---|---|---|---|---|
| | SF1 | SF2 | SF3 | SF1 | SF2 | SF3 |
| GRADATION LEVEL 0 | 0 | 0 | 0 | 0 | 0 | 0 |
| GRADATION LEVEL 1 | 1 | 0 | 0 | 1 | 0 | 0 |
| GRADATION LEVEL 2 | 0 | 2 | 0 | 0 | 1 | 0 |
| GRADATION LEVEL 3 | 1 | 2 | 0 | 1 | 1 | 0 |
| GRADATION LEVEL 4 | 0 | 0 | 4 | 0 | 0 | 1 |
| GRADATION LEVEL 5 | 1 | 0 | 4 | 1 | 0 | 1 |
| GRADATION LEVEL 6 | 0 | 2 | 4 | 0 | 1 | 1 |
| GRADATION LEVEL 7 | 1 | 2 | 4 | 1 | 1 | 1 |

DISPLAY DEVICE AND PLASMA DISPLAY APPARATUS

BACKGROUND OF THE INVENTION

1. Field of the Invention

The present invention relates to a color display device and a method for driving the device.

A plasma display panel (PDP) is used as a television display device having a large screen. Since the PDP is also suitable for a public display for its good viewability, a plurality of PDPs are often combined to be used as a multiscreen.

2. Description of the Prior Art

In display of an AC type PDP having display electrodes covered with a dielectric layer, line-sequential addressing is performed for setting wall voltage of cells in accordance with display data, followed by sustaining process in which a sustaining voltage pulse is applied to the cells. In other words, the addressing process determines light or non-light, and the sustaining process generates display discharge at the number of times in accordance with the luminance of display. Since the PDP cell is basically a binary light emission element, an image having different luminance for each pixel cannot be displayed in one addressing process. Therefore, a frame to be displayed is divided into a plurality of subframes, and the addressing process and the sustaining process are performed for each subframe. In the case of an interlace display, each of fields constituting the frame is divided into subfields. As a simple example, a subframe division number K is set to three, and a ratio of luminance weights (i.e., light emission quantities) is set to 1:2:4 for total three sustaining processes as shown in FIG. 12A. An eight-level gradation display having gradation levels 0–7 can be performed by selecting light or non-light for the first subframe (SF1), the second subframe (SF2) and the third subframe (SF3) as shown in FIG. 12B. A color display can be performed by applying this gradation display to R (red), G (green) and B (blue) cells.

In the above-mentioned gradation display by the subframe division, the number of gradation levels that can be displayed increases as the division number K increases. However, since the addressing process of one screen is necessary for each subframe, the number of times of addressing that can be performed during a period that is determined by a frame rate (usually 1/30 seconds) is limited. Therefore, the subframe division is limited. Actually, the upper limit is 256 gradation levels for the division into eight subframes.

Concerning this problem, Japanese unexamined patent publication No. 2000-100333 discloses a method for increasing the number of gradation levels by assigning a plurality of cells having the same color to one pixel. Namely, one pixel is displayed by total six cells including two each of R, G and B colors. Since the light emission quantity is changed by lighting one or both of the two cells, the light emission quantity can be set to three kinds including non-light by one addressing process.

However, in the plasma display panel disclosed in the above-mentioned publication, characteristics of all cells are the same concerning drive control, and electrodes are arranged equally in all cells. Namely, as a common structure in which one pixel is displayed by three cells including one each of R, G and B colors, electrodes are arranged so as to control light or non-light of each cell. Therefore, the number of electrodes increases as cells having the same color corresponding to one pixel increases. Thus, a driving device (an integrated circuit module) having output terminals covering the number is necessary.

SUMMARY OF THE INVENTION

An object of the present invention is to increase the number of gradation levels that can be displayed without increasing the number of terminals of a driving device.

In one aspect of the present invention, at least (M+1) types of light emission quantity control including non-light emission can be performed by arranging M (two or more) cells having the same color in a display black of one pixel in an image display screen and by making respective structures of these cells partially different from each other. Namely, response characteristics of the M cells to the control are made different from each other. Thus, even if electrodes that are disposed at the M cells are connected electrically to each other, any number from 1 to M of cells can be selected in the order of sensitivity to low potential by switching potential of the electrodes. The number of selections become (M+1) including non-selection.

In a plasma display panel that utilizes gas discharge for light emission, the following elements are selected for making the structure different.

(1) Area of electrode for addressing
(2) Size of discharge space
(3) Thickness or material of a dielectric layer in an AC type
(4) Thickness or material of a fluorescent material layer for color display.

BRIEF DESCRIPTION OF THE DRAWINGS

FIG. 8 is a diagram showing relationship between gradation and address voltage.

FIGS. 10A–10F are diagrams showing variations of the cell structure.

DESCRIPTION OF THE PREFERRED EMBODIMENTS

Hereinafter, the present invention will be explained more in detail with reference to embodiments and drawings.

Figure 1:
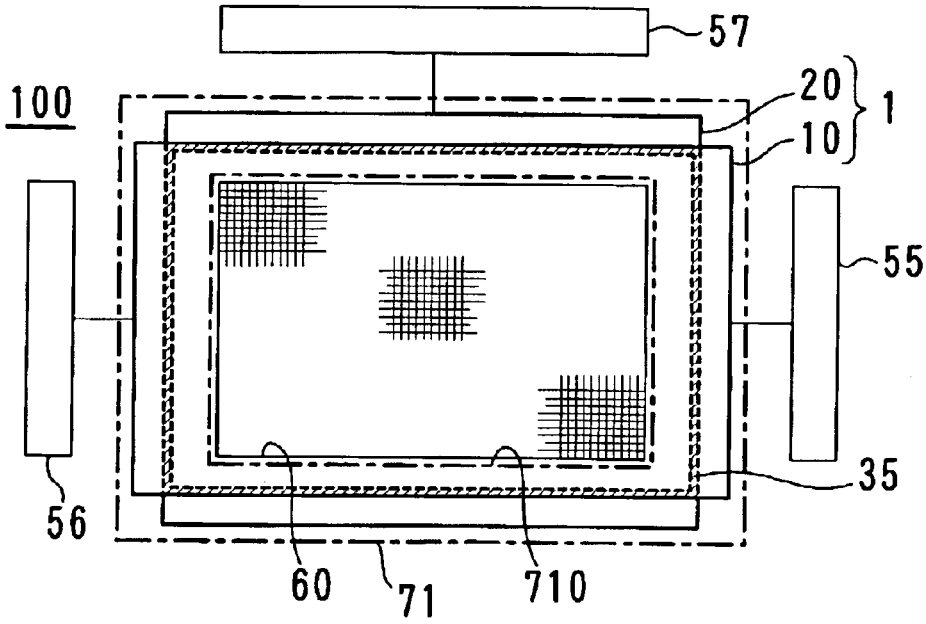
FIG. 1 is a diagram showing a general structure of a plasma display apparatus according to the present invention.

FIG. 1 is a diagram showing a general structure of a plasma display apparatus according to the present invention. A plasma display apparatus 100 comprises a PDP 1, a housing 71 and a drive unit. The PDP 1 includes a pair of substrate structural bodies 10 and 20. The substrate structural body means a structure including a plate-like support having a size larger than a screen and at least one type of panel structuring element. The substrate structural bodies 10 and 20 are arranged so as to be opposed and overlapped to each other, and the peripheral portion of the opposed area is bonded with a sealing material 35. The housing 71 encloses the PDP 1 and the drive unit. However, the housing 71 has a window 710 having the screen size and does not hide a display screen 60 that is a part of the front portion of the PDP 1. The drive unit has drivers 55, 56 and 57 that are connected to electrodes of the PDP 1. Though the drivers 55, 56 and 57 are disposed at the peripheral portion of the PDP 1 in FIG. 1, they are actually disposed at the backside of the PDP 1. The drive unit is attached to the backside of the PDP 1, and the drive unit is attached to the housing 71 so that the PDP 1 is fixed to the housing 71.

Figure 2:
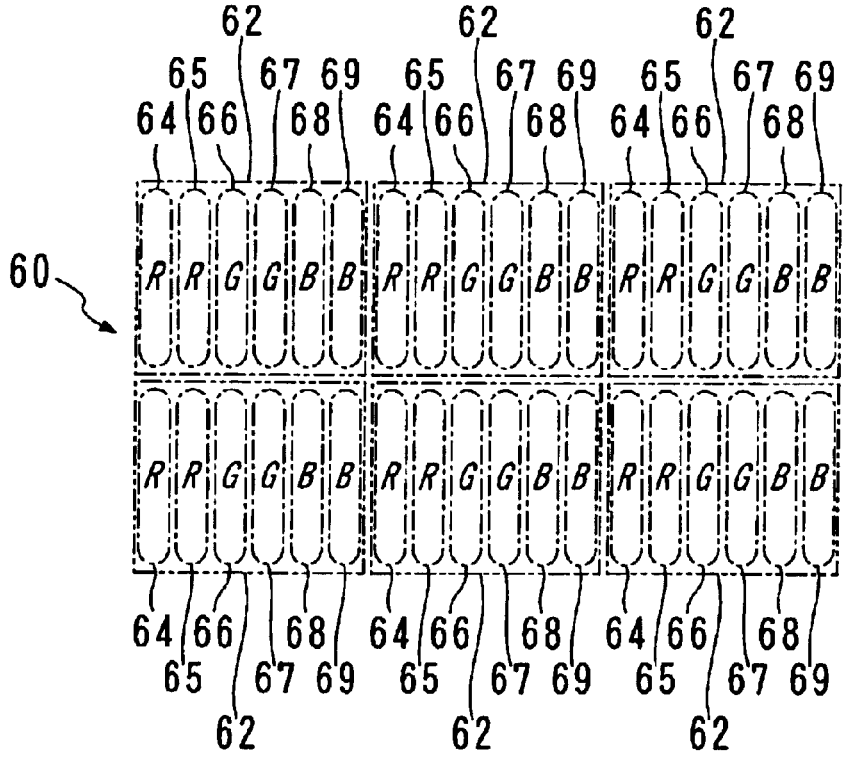
FIG. 2 is a diagram showing a cell arrangement of a display screen.
Figure 2A:
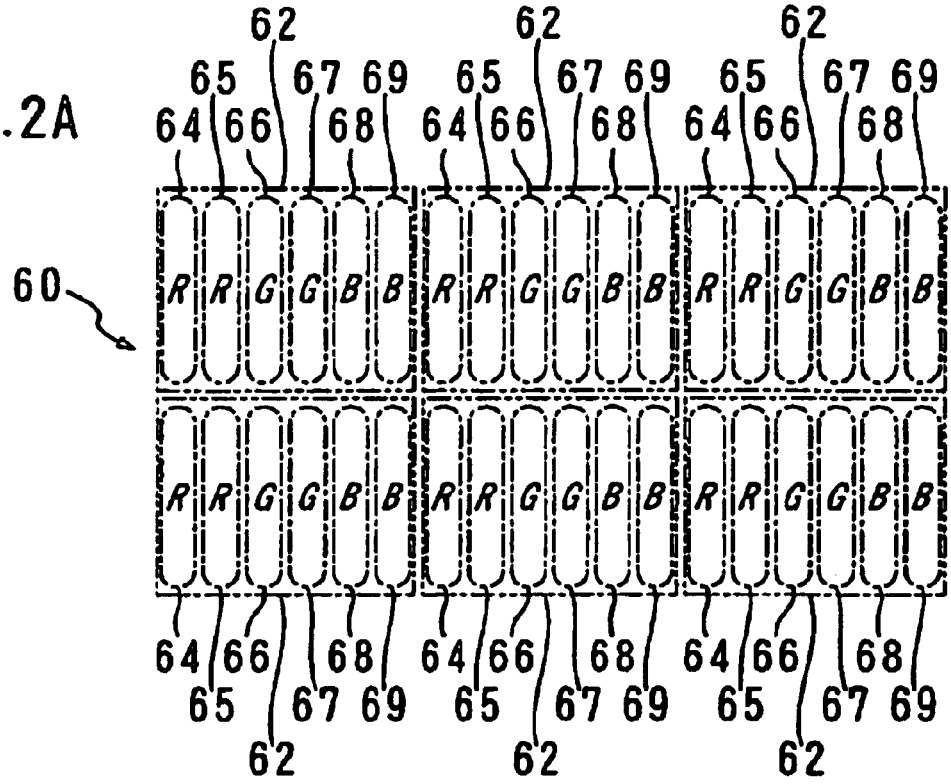
Figure 2B:
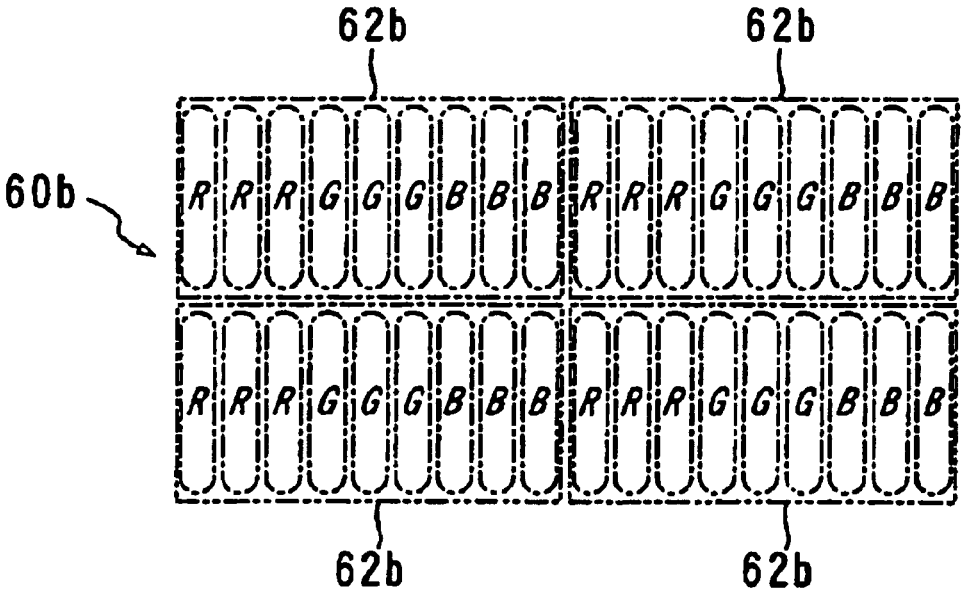

FIG. 2 shows a cell arrangement of a display screen. The illustrated display screen 60 is a square arrangement type in which display blocks 62 each of which corresponds to one pixel of a color image are arranged in the horizontal direction and in the vertical direction. Each of the display blocks 62 is made of total six cells 64, 65, 66, 67, 68 and 69 including two each of red, green and blue colors. Italic letters R, G and B represent light colors in FIG. 2. The six cells 64–69 are arranged in the horizontal direction, and the color arrangement pattern is RRGGBB in which two neighboring cells have the same color. All display blocks 62 in the display screen 60 have the same color arrangement pattern. Namely, the color arrangement in the horizontal direction has a pattern repeating RRGGBB, and the color arrangement in the vertical direction has a pattern in which cells have the same color.

Figure 3:
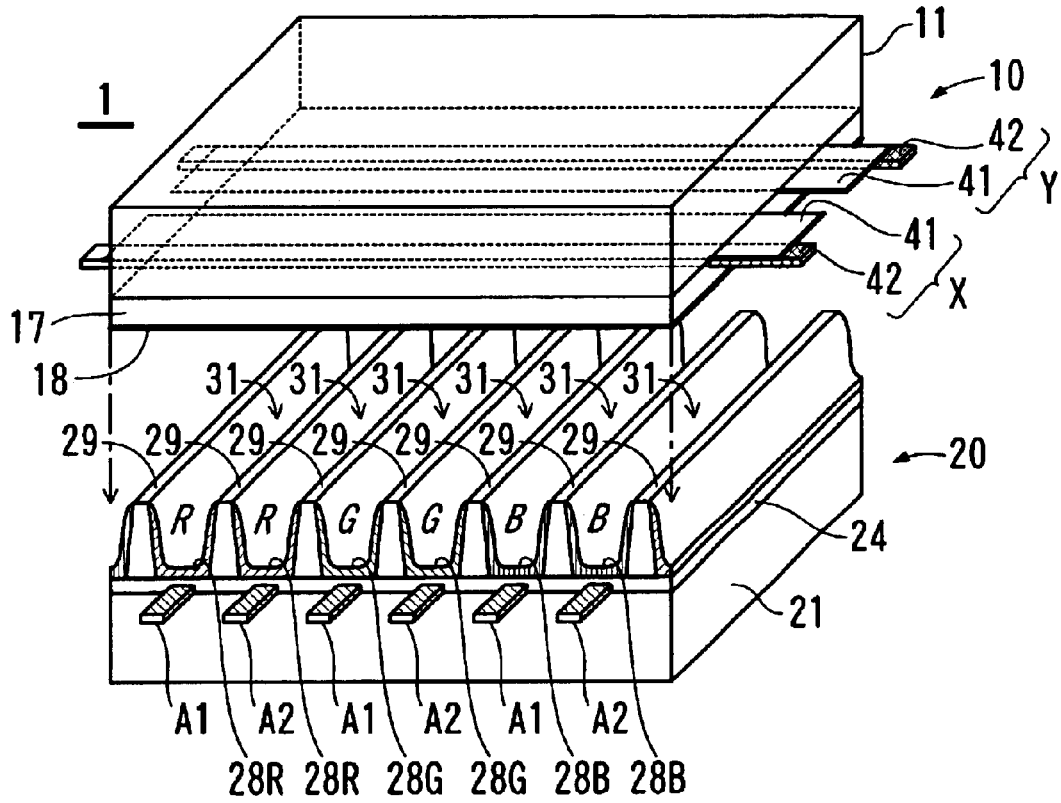
FIG. 3 is a diagram showing a cell structure of a PDP according to the present invention.

FIG. 3 is a diagram showing a cell structure of the PDP according to the present invention. In FIG. 3, a portion of the PDP 1 corresponding to one display block (of one pixel) is shown in a manner that two substrate structural bodies are separated so that the inner structure can be seen well.

In one display block, a pair of display electrodes X and Y running over six cells crosses total six of address electrodes A1 and A2 that are arranged in each cell. The display electrodes X and Y are arranged on the inner surface of the front glass substrate 11, and each of the display electrodes X and Y includes a transparent conductive film 41 that forms a surface discharge gap and a metal film (a bus electrode) 42 that enhances conductivity. The display electrode pair is covered with a dielectric layer 17 having a thickness of approximately 30–50 $\mu$m for forming wall charge, and the surface of the dielectric layer 17 is coated with a protection film 18 made of magnesia (MgO). The address electrodes A1 and A2 are arranged on the inner surface of the back glass substrate 21 and are covered with an insulator layer 24. On the insulator layer 24, partitions 29 having a band-like shape in a plan view and having a height of approximately 140 $\mu$m are disposed so that one partition 29 corresponds to an arrangement gap between the address electrodes A1 and A2. The partitions 29 divide a discharge space into columns in the direction along the row of the matrix display, and a size of the discharge space in the front and back direction is defined. A column space 31 that corresponds to each column of the discharge space is continuous over all rows. The inner surface of the back side including over the address electrodes A1 and A2 and the side face of the partitions 29 is provided with fluorescent material layers 28R, 28G and 28B of red, green and blue colors for color display. Italic letters R, G and B in FIG. 3 represent light emission colors of the fluorescent materials. The discharge gas is a mixture of neon (Ne) 90% and xenon (Xe) 10%, and its filled pressure is 500 torr.

In display of the PDP 1, a reset process is performed for equalizing wall charge quantity of all cells, and then addressing process is performed. In the addressing process, the display electrode Y is biased to a row selection potential, and only the address electrodes A1 and A2 corresponding to the cells in which the address discharge is to be generated are biased to an address potential. In the case of write-form addressing for example, the address discharge is generated in cells to be lighted. Potential relationship of three electrodes including the display electrode X is set appropriately, so that the address discharge at the interelectrode between the display electrode Y and the address electrode A1 or A2 extends to the interelectrode between the display electrode Y and the display electrode X. Thus, appropriate quantity of wall charge is accumulated in the dielectric layer at the vicinity of the surface discharge gap. Namely, predetermined wall voltage is formed. After the addressing process, as a sustaining process, a sustain pulse having an amplitude lower than discharge start voltage is applied to all cells. More specifically, the display electrode Y and the display electrode X are biased to the sustain potential alternately, so that alternating voltage is applied across the display electrodes. Surface discharge is generated on the substrate surface as display discharge only in the cells (the above-mentioned cells to be lighted) having the voltage of the sustain pulse plus predetermined wall voltage. On this occasion, the fluorescent material layers 28R, 28G and 28B are excited locally by ultraviolet rays emitted by the discharge gas and emit light. The surface discharge inverts polarity of the wall voltage, so display discharge is generated again in the next application of the sustain pulse. Luminance of a display depends on total light emission quantity (integral light emission quantity) of intermittent lighting at the pulse period.

Figure 4:
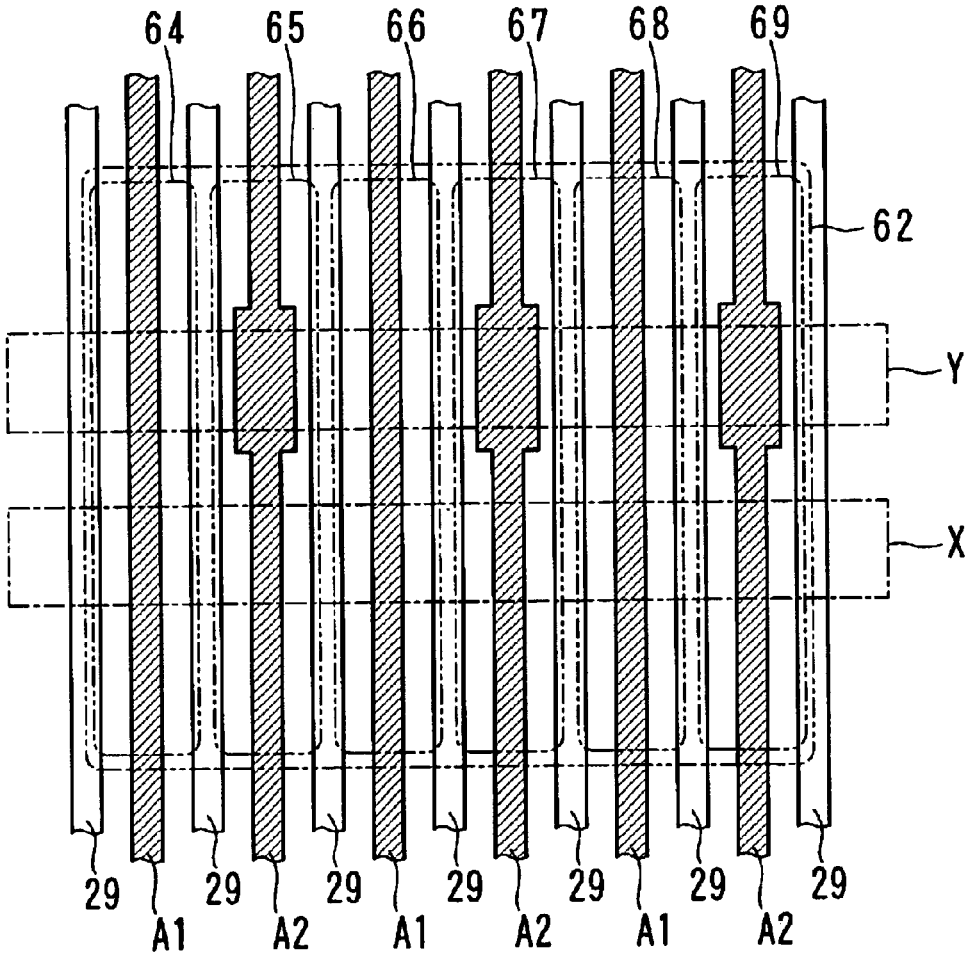
FIG. 4 is a diagram showing a plan view of an address electrode.

FIG. 4 is a diagram showing a plan view of an address electrode. One display block 62 has three sets of cells having the same color. The first set is an R set including a cell 64 and a cell 65, the second set is a G set including a cell 66 and a cell 67, and the third set is a B set including a cell 68 and a cell 69. In each of these sets, one group of cells 64, 66 and 68 is provided with the address electrodes A1, and the other group of cells 65, 67 and 69 are provided with the address electrodes A2. Each of the address electrodes A1 and the address electrodes A2 is a band-like metal film. However, there is a difference between shapes of these electrodes. The width of the address electrode A1 is constant, while the width of the address electrode A2 is large only at intersections with the display electrode Y. An opposed area of the address electrode A2 to the display electrode Y is larger than that of the address electrode A1. Namely, discharge between the address electrode A2 and the display electrode Y can be generated more easily (i.e., the discharge start voltage is lower) than discharge between the address electrode A1 and the display electrode Y. This means that even if the same voltage is applied to the interelectrode between the address electrode A2 and the display electrode Y as well as the interelectrode between the address electrode A1 and the display electrode Y, discharge will be generated only in the cells 65, 67 and 69 under the condition of the voltage value being below a constant value, and discharge will be generated in the cells 64–69 when the voltage value exceeds the constant value. Even if the number of terminals is decreased by connecting the address electrode A1 to the address electrode A2 for each of the above-mentioned sets, the three-value light emission control is possible in which the number of cells that are lighted in each set is selected from 0, 1 and 2.

Figure 5:
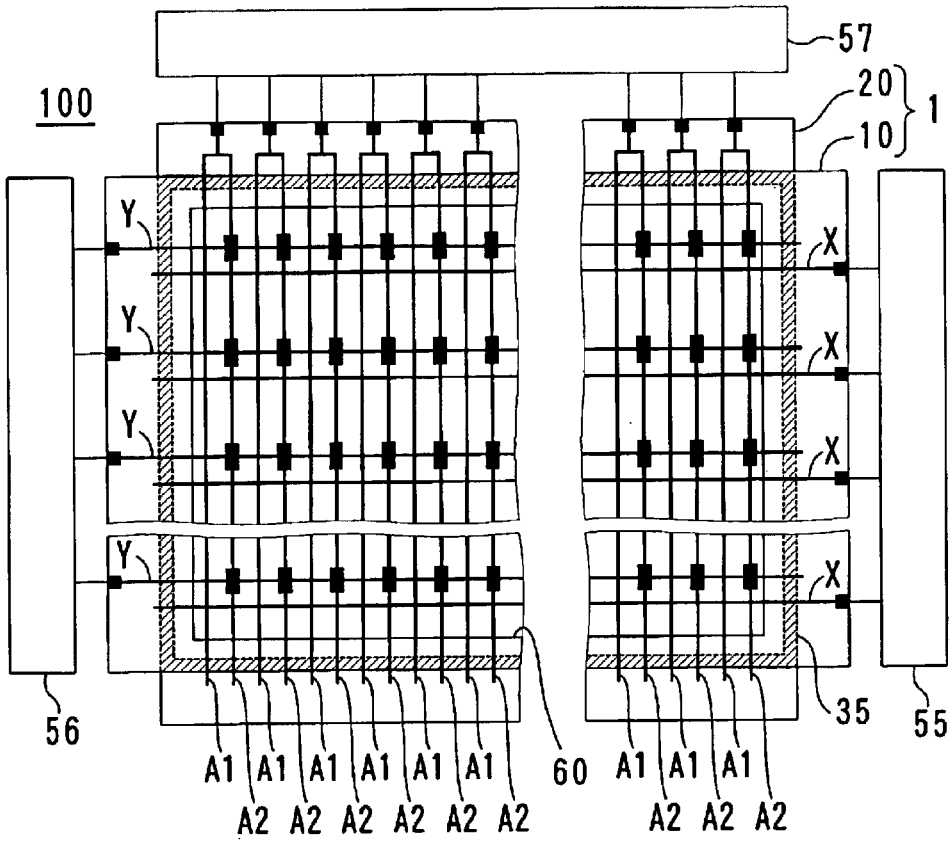
FIG. 5 is a schematic diagram of an electrode matrix.

FIG. 5 is a schematic diagram of an electrode matrix. In the plasma display apparatus 100, each address electrode A1 is connected to the neighboring address electrode A2 outside the display screen 60. In this way, the number of terminals necessary for the driver 57 is reduced to a half of the total number of address electrodes A1 and address electrodes A2. In the illustrated example, the connection is performed in the substrate structural body 20 by the electrode pattern design, so it is easy to make the registration between the terminals on the substrate structural body 20 and the flexible cable for connecting the driving circuit on the backside. Therefore, the contact pad is enlarged so that reliability of the contact can be improved. However, it is not limited to this connection form. The connection can be achieved also by wiring pattern design of the flexible cable or the driving circuit substrate.

Figure 6:
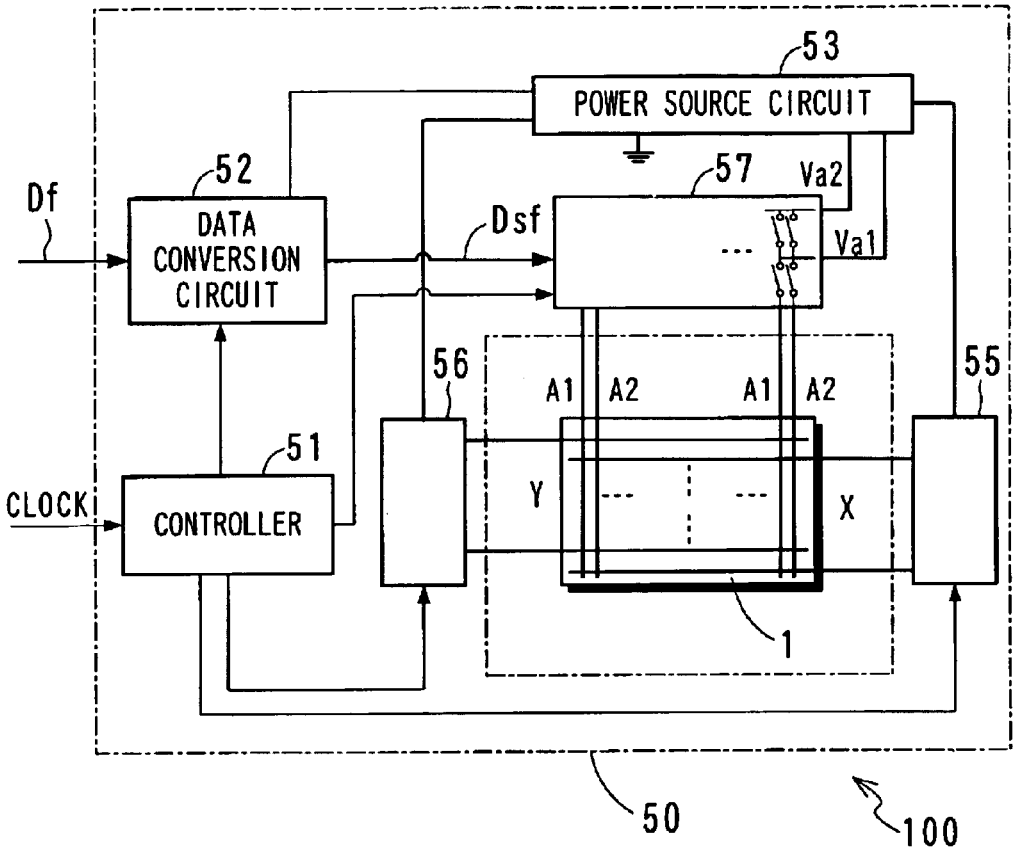
FIG. 6 is a block diagram showing a driving circuit of the plasma display apparatus according to the present invention.

FIG. 6 is a block diagram showing the driving circuit of the plasma display apparatus according to the present invention. The drive unit 50 includes a controller 51, a data conversion circuit 52, a power source circuit 53 and drivers 55, 56 and 57. The drive unit 50 is supplied with frame data Df indicating luminance levels of red, green and blue colors together with a synchronizing signal CLOCK and other control signals from an external device such as a TV tuner or a computer. The frame data Df is full color data of total 24 bits including three colors per pixel. The data conversion circuit 52 converts the frame data Df into subframe data Dsf for gradation display. The value of each bit of the subframe data Dsf indicates whether a cell in one subframe is to be lighted or not, more specifically whether the address discharge is necessary or not. In an interlace display, each of plural fields that constitute a frame is made of plural subfields, and the light emission control is performed for each subfield. However, the light emission control itself is the same as the case of the progressive display. The driver 55 controls potential of the display electrode X, while the driver 56 controls potential of the display electrode Y. The driver 57 controls potential of the address electrodes A1 and A2 in accordance with the subframe data Dsf from the data conversion circuit 52. These drivers 55–57 are supplied with a control signal from the controller 51 and a predetermined power from the power source circuit 53. Especially, the driver 57 is supplied with two address voltages Va1 and Va2 for the three-value light emission control.

Next, a method for driving the PDP 1 in the plasma display apparatus 100 will be explained.

Since the cells 64–69 of the PDP 1 are binary light emission elements, one frame is made of a plurality of subframes (or subfields in the case of the interlace display) weighted by luminance, and the integral light emission quantity in the frame period is controlled by combination of on and off of the light emission for each subframe for performing color display similarly to the conventional method. The driving sequence is a repetition of reset, addressing and sustaining. Though the time necessary for reset and addressing is constant regardless of the luminance weight, the time for sustaining is longer as the luminance weight is larger. In the driving sequence, the present invention is applied to the addressing.

General explanation of the addressing is as follows. In the address period that is prepared for each subframe, a display electrode Y corresponding to a selected row is biased temporarily to the row selection potential (application of a scan pulse). In synchronization with this row selection, the address electrodes A1 and A2 in the selected row that correspond to selected cells that generate address discharge are biased to the address potential Va1 or the address potential Va2 (Va2<Va1) as application of the address pulse. The address electrodes A1 and A2 that correspond to the non-selected cells are set to the ground potential (usually, zero volt). Similar operation is performed for all rows sequentially. As explained with reference to FIG. 4, the opposed area of the address electrode A2 to the display electrode Y is large, so address discharge can be generated relatively easily between these electrodes. Specifically, the lowest application voltage necessary for address discharge in the cells 65, 67 and 69 is 43–46 volts. In contrast, the lowest application voltage necessary for address discharge in the cells 64, 66 and 68 in which the address electrode A1 and the display electrode Y are opposed to each other is 53–56 volts. Therefore, in order to light both the cells in one display block 62 having the same color such as the cell 64 and the cell 65, the cell 66 and the cell 67 or the cell 68 and the cell 69, voltage of 60 volts is applied to the address electrode A1 and the address electrode A2 (more specifically, across the address electrode and the ground line). In order to light only one cell (the cell 65, 67 or 69), voltage of 50 volts is applied to the address electrode A1 and the address electrode A2. Hereinafter, gradation display by the three-value light emission quantity control will be explained in detail.

Figure 7:
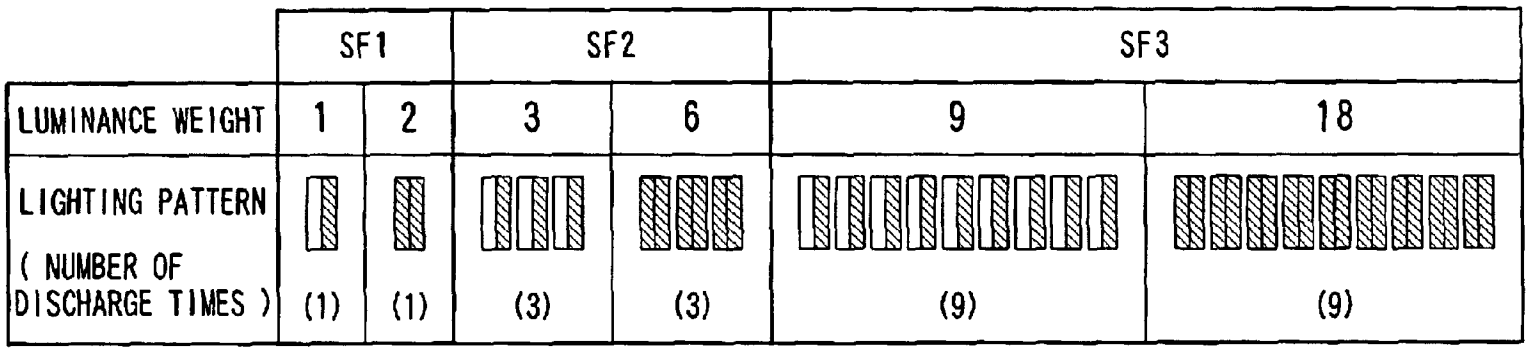
FIG. 7 is a diagram showing an example of frame division and weighting of luminance.
Figure 9:
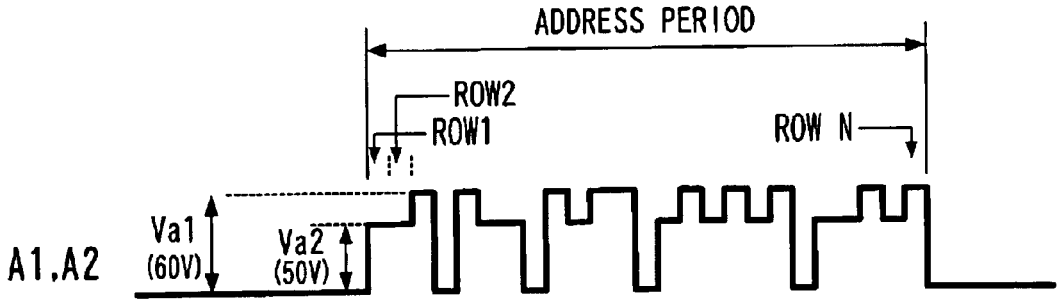
FIG. 9 is a waveform diagram showing control of address electrodes.

FIG. 7 is a diagram showing an example of frame division and weighting of luminance. FIG. 8 is a diagram showing relationship between gradation and address voltage. FIG. 9 is a waveform diagram showing control of address electrodes.

Figures 12A, 12B:
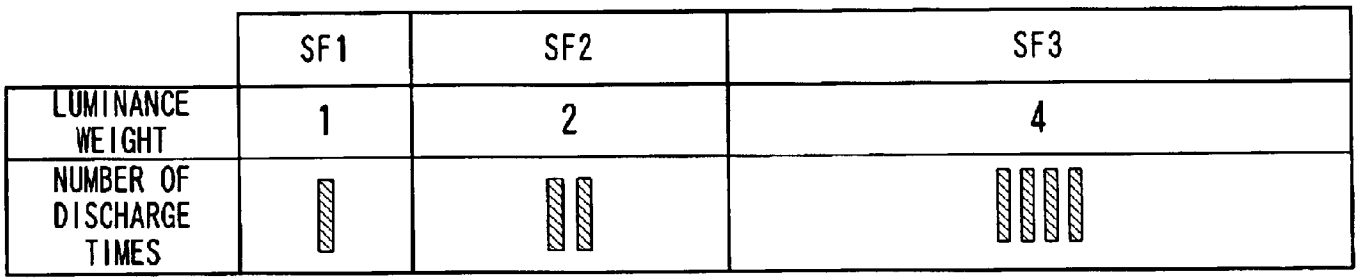
FIG. 12A PRIOR ART
FIG. 12B PRIOR ART
FIGS. 12A and 12B are explanatory diagrams showing the conventional gradation display.

In order to understand easily the difference between the conventional method shown in FIG. 12 and the present invention, a frame is divided into three subframes (SF1, SF2 and SF3 in FIG. 7) in this example. As weight of luminance, the first subframe (SF1) is given 1 and 2, the second subframe (SF2) is given 3 and 6, and the third subframe (SF3) is given 9 and 18. If the weight has a value such as 1, 3 or 9 that can be expressed with $1\times3^n$ ($0\leqq n\leqq 2$), only one cell of the cell pair having the same color in the display block 62 is lighted. If the weight has a value such as 2, 6 or 18 that can be expressed with $2\times3^n$, both the cells of the cell pair having the same color are lighted. In both cases, the number of discharge times is made proportional to the weight. However, it is not required to be proportional precisely. Some misregistration is allowed within a range that does not deteriorate continuity of the gradation. As shown in FIG. 8, a combination of weights is determined for each gradation, and it is determined for each subframe which one is set in the addressing; lighting one of two, lighting both or lighting neither. In the case of lighting one cell, a low address voltage Va2 (L in FIG. 8) is applied, while in the case of lighting both cells, a high address voltage Va1 (H in FIG. 8) is applied. By this driving method, a display having 27 gradation levels from the gradation 0 to the gradation 26. Compared with the conventional method having eight gradation levels in a three-part split frame, it is understood that the present invention can improve gradation property substantially. In addition, increase of the number of terminals in wiring can be avoided by connecting the address electrode A1 to the address electrode A2.

As a variation of the potential control of the address electrode A1 and the address electrode A2, there is a controlling method in which the address voltage is not switched during the address period of one subframe, and either the high address voltage Va1 or the low address voltage Va2 is fixed during the address period. In a frame having many pixels with high luminance, the high address voltage Va1 is applied so as to light both cells of the cell pair. On the contrary, in a frame having many pixels with low luminance, a low address voltage Va2 is applied so as to light one cell of the cell pair. In addition, values of the address voltages Va1 and Va2 are not necessarily common to red, green and blue colors. The values of the address voltages Va1 and Va2 can be determined individually for each of red, green and blue colors, e.g., 45 volts and 50 volts for red, 50 volts and 55 volts for green, and 55 volts and 60 volts for blue. Furthermore, the number of cells having the same color that belong to one display block 62 is set to three or more so that the number of gradation levels increases. The color arrangement is not limited to such as RRGGBB in which two neighboring cells have the same color but can be such as RGBRGB in which neighboring cells have different light colors. The arrangement of the display blocks 62 is not limited to the square arrangement but can be a triangular arrangement for example, in which neighboring blocks are shifted from each other by a half pitch.

OTHER EXAMPLES

Figure 10A:
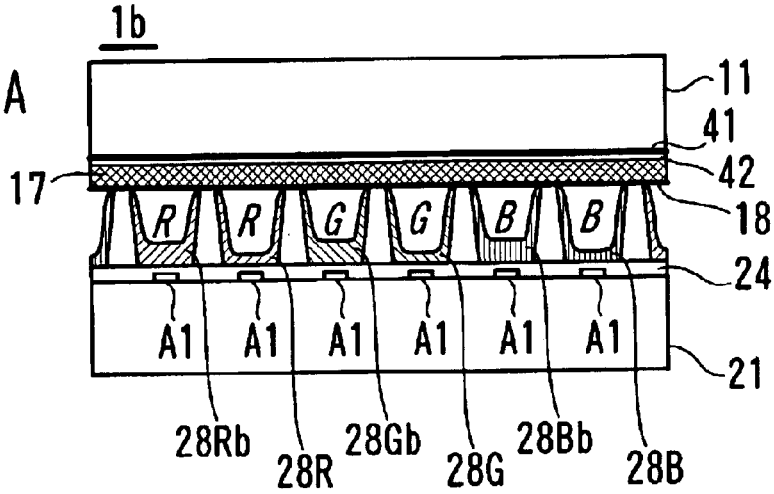
FIGS. 10A–10C are diagrams showing variations of the cell structure.
Figure 10B:
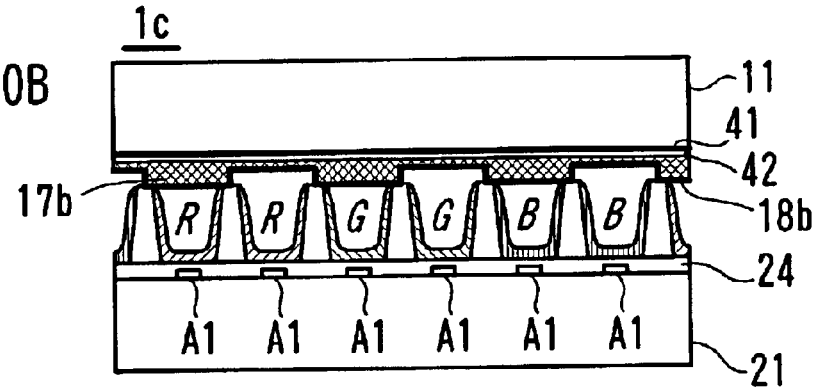
Figure 10C:
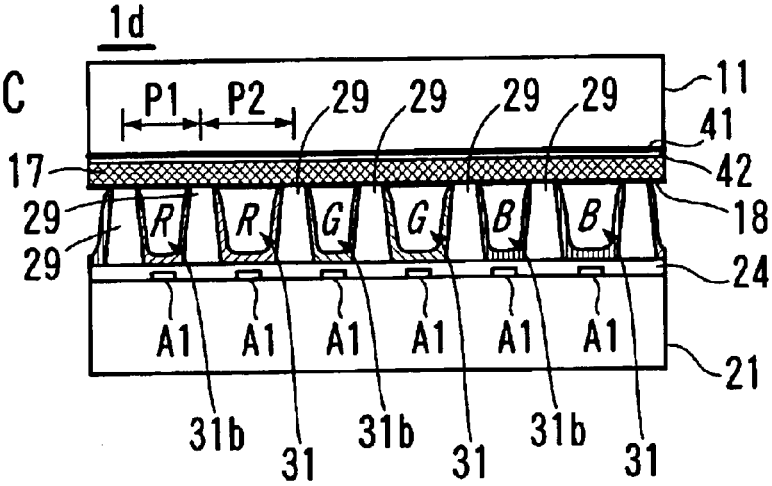

FIGS. 10A–10C are diagrams showing variations of the cell structure. In the PDP 1*b* shown in FIG. 10A, the fluorescent material layers 28Rb, 28Gb and 28Bb arranged in one of the cells having the same color are made thicker than the fluorescent material layers 28R. 28G and 28B arranged in the other of the cells, so that the address discharge start voltages are different from each other in the cell pair. The address electrodes A1 having the same shape are arranged in all cells. In the PDP 1*c* shown in FIG. 10B, the dielectric layer 17*b* of one of the cells having the same color has a thickness different from that of the other of the cells, so that the address discharge start voltage are different from each other in the cell pair. In the PDP 1*d* shown in FIG. 10C, pitches P1 and P2 of the partition 29 are different from each other. Therefore, the width of the column spaces 31 and 31*b* for generating gas discharge are different from each other, so that the address discharge start voltage are different from each other in the cell pair. Furthermore, the shape of the partition can be a grid shape that defines each cell completely.

Figure 10D:
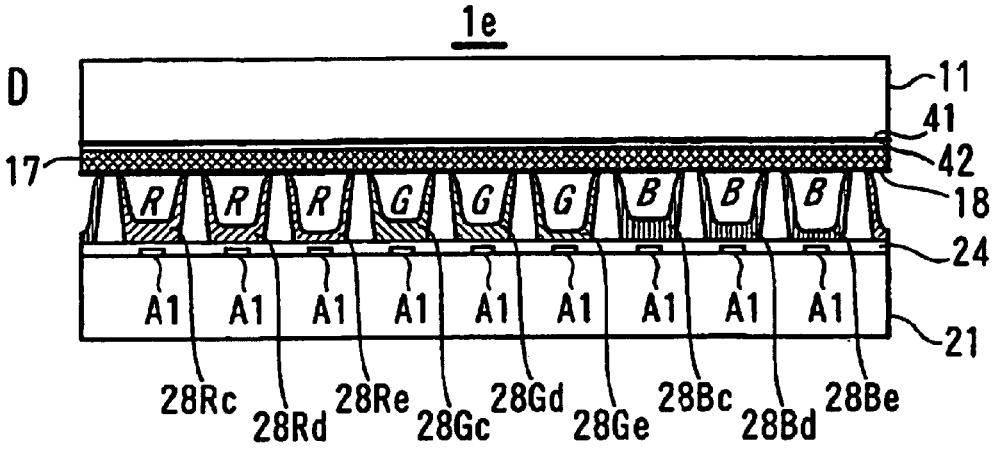
Figure 10E:
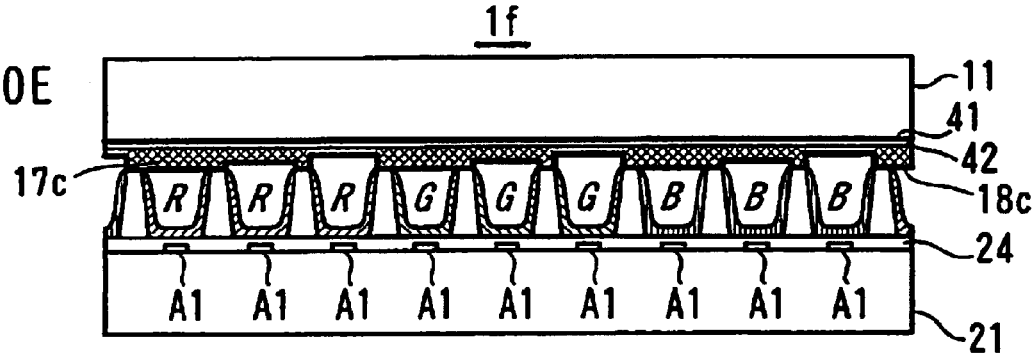
Figure 10F:
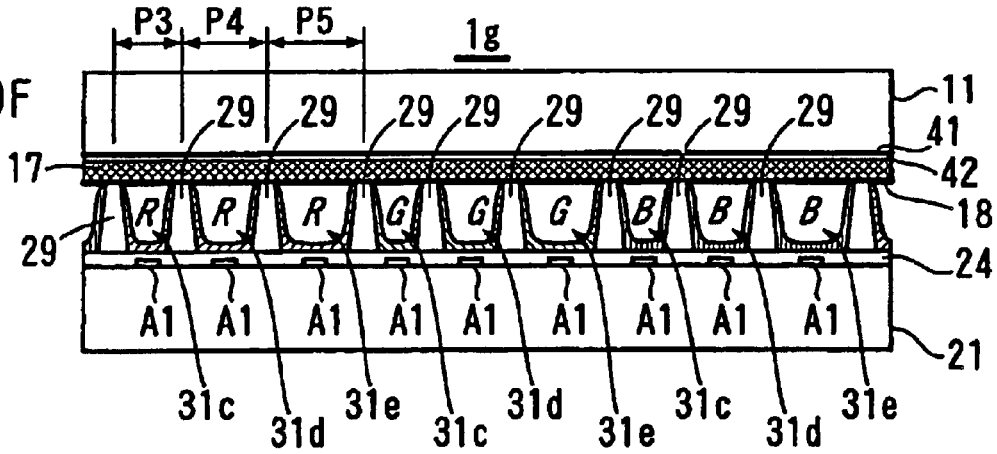

FIGS. 10D–10F are diagrams showing variations of the cell structure similar to those shown in FIGS. 10A–10C, respectively, where more than two cells are arranged having the same color in the display block of one pixel in the image display screen. In the PDP 1*e* shown in FIG. 10D, the fluorescent material layers 28Rd, 28Gd and 28Bd arranged in one of the cells having the same color are made thicker than the fluorescent material layers 28Rc, 28Gc and 28Bc arranged in the other of the cells, and the fluorescent material layers 28Re, 28Ge and 28Be arranged in one of the cells having the same color are made thicker than the fluorescent material layers 28Rd, 28Gd and 28Bd arranged in the other of the cells, so that the address discharge start voltage is different from each other in the cell pair. The address electrodes A1 having the same shape are arranged in all cells. In the PDP 1*e* shown in FIG. 10E, the dielectric layer 17*c* of one of the cells having the same color has a thickness different from that of the other of the cells, so that the address discharge start voltage is different from each other in the cell pair. In the PDP 1*g* shown in FIG. 10F, pitches P3, P4 and P5 of the partition 29 are different from each other. Therefore, the width of the column spaces 31*c*, 31*d* and 31*e* for generating gas discharge is different from each other, so that the address discharge start voltage is different from each other in the cell pair. Furthermore, the shape of the partition can be a grid shape that defines each cell completely.

Figure 11A:
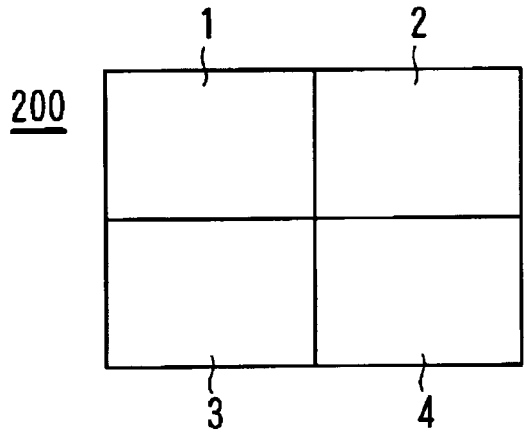
FIGS. 11A and 11B are diagrams showing general structures of a multiscreen display apparatus.
Figure 11B:
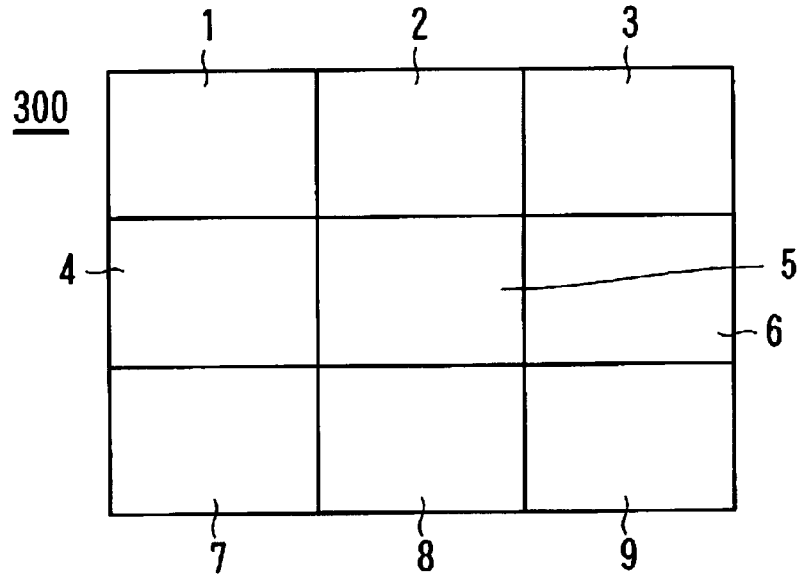

The present invention can be also applied to a multiscreen display apparatus 200 having four screens that is a combination of four PDPs 1, 2, 3 and 4 having the same structure as shown in FIG. 11A or a multiscreen display apparatus 300 having nine screens that is a combination of nine PDPs 1, 2, 3, 4, 5, 6, 7, 8 and 9 having the same structure as shown in FIG. 11B. If a multiscreen has a resolution that is the same as a resolution of a single screen, a size of a display block of one pixel is an integral multiple of that of a single screen. In this case, if four of the PDP 1 in which the address electrodes A1 and A2 are connected to each other as explained above are arranged so as to make a multiscreen having four screens as shown in FIG. 11A, the number of terminals necessary for connecting the address electrodes A1 and A2 to the driving circuit becomes the same vale as the number of columns of one PDP 1. Therefore, the driving circuit substrate for a conventional PDP having address electrodes that are independent for each column can be used for driving the multiscreen, so that the multiscreen display apparatus can be made inexpensively.

In addition, the partial difference between the structures of the cells having the same color and the common electrode that can prevent the number of terminals from increasing in the PDP 1 according to the present invention can be applied to a display apparatus utilizing a device other than the PDP, such as an LCD, an FED (a field emission display), an organic electro luminescence or a DMD (a digital mirror device).

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A display device, comprising:

an image display screen divided into display blocks, wherein each display block corresponds to a pixel including a plurality of cells with M (two or more) cells, having a same light color, and the M cells in the display block have respective structures partially different from each other so that application of a common voltage to the M cells enables light emission quantity control in which light emission quantity in the display block has at least (M+1) values including a non-light emission value.

2. A color display device, comprising:

an image display screen made of cells having light colors comprising R(red), G(green), and B(blue) and divided into display blocks, wherein each display block corresponds to a pixel and is made of four or more cells comprising at least one of each of the R cells, G cells, and B cells, and at least two of the cells having the same light color, where the cells having the same light color in the display block have structures partially different from each other.

3. The color display device according to claim 2, wherein the structure of the cells having the same light color are partially different from each other perform at least (M+1) types of light emission quantity control including non-light emission, where M comprises two or more cells.

4. A plasma display panel, comprising:

an image display screen comprising cells having light colors comprising R(red), G(green), and B(blue);

display electrodes to light the cells; and address electrodes to control light emissions of the cells, wherein the image display screen is divided into display blocks, each display block corresponding to a pixel and comprising four or more of the cells including at least one of each of the R cells, the G cells, and the B cells, where at least two cells have the same light color with structures different from each other to perform at least (M+1) types of light emission quantity control including non-light emission, where M comprises two or more cells.

5. The plasma display panel according to claim 4, wherein areas of the address electrodes disposed at the cells having the same light color in the display block are different from each other.

6. The plasma display panel according to claim 4, further comprising:

a dielectric layer to cover the display electrodes, wherein the dielectric layer covering the cells having the same light color in the display block has a different thickness for each cell.

7. The plasma display panel according to claim 4, wherein the cells having the same light color in the display block have discharge spaces with dimensions different from each other.

8. The plasma display panel according to claim 4, wherein the address electrodes connect cells having the same light color in the display block to each other, outside the image display screen.

9. A plasma display panel, comprising:

an image display screen comprising:

cells having light colors comprising R(red), G(green), and B(blue);

display electrodes to light the cells; and address electrodes to control light emissions of the cells, wherein the image display screen is divided into display blocks, each display block corresponding to a pixel having a total of six cells including two of each of the R cells, the G cells and the B cells, where areas of the two address electrodes disposed the two cells having the same light color in the display block are different from each other.

10. A plasma display apparatus, comprising:

a plurality of plasma display panels arranged in parallel, each of the plasma display panels comprising an image display screen made of cells having light colors comprising R(red), G(green), and B(blue), wherein the image display screen is divided into display blocks, each display block corresponding to a pixel and comprising four or more cells comprising at least one of each of the R cells, the G cells, and the B cells, where at least two cells have the same light color and with structures that are partially different from each other.

11. A method to drive a plasma display panel comprising an image display screen made of cells having light colors comprising R(red), G(green), and B(blue), display electrodes to light the cells, and address electrodes to control light emissions of the cells, wherein the image display screen is divided into display blocks, each display block corresponding to a pixel and comprising four or more of the cells having at least one of each of the R cells, the G cells, and the B cells, where at least two cells have the same light color with structures different from each other to perform at least (M+1) types of light emission quantity control including non-light emission, where M comprises two or more cells, the method comprising:

connecting the cells, having the same light color in the display block, to each other, outside the image display screen, using the address electrodes;

applying a voltage to the address electrodes connecting the cells; and switching the applied voltage to control a number of the cells that are lighted among the cells having the same light color.

12. A method to drive a plasma display panel comprising an image display screen made of cells having light colors comprising R(red), G(green), and B(blue), display electrodes to light the cells, and address electrodes to control light emissions of the cells, wherein the image display screen is divided into display blocks, each display block corresponding to a pixel having a total of six cells including two of each of the R cells, the G cells and the B cells, where areas of the two address electrodes disposed the two cells having the same light color in the display block are different from each other, the method comprising:

dividing a frame to be displayed into a plurality of subframes that are weighted by luminance; and performing a three-value light emission control of a gradation display in which a single light emission, both light emission, or both non-light emission is selected for the two cells having the same light color in the display block, in each subframe.

13. A method to drive a plasma display panel comprising an image display screen made of cells having light colors comprising R(red), G(green), and B(blue), display electrodes to light the cells, and address electrodes to control light emissions of the cells, wherein the image display screen is divided into display blocks, each display block corresponding to a pixel having a total of six cells including two of each of the R cells, the G cells and the B cells, where areas of the two address electrodes disposed the two cells having the same light color in the display block are different from each other, the method comprising:

dividing a frame to be displayed into K (two or more) subframes;

assigning two values $1\times3^n$ and $2\times3^n$ using n ($0\leqq n\leqq K-1$) as a luminance weight to each of the K subframes; and performing a three-value light emission control of a gradation display in which a single light emission, both light emission, or both non-light emission is selected for the two cells having the same light color in the display block, in each subframe.

14. A method to drive a plasma display panel comprising an image display screen made of cells having light colors comprising R(red), G(green), and B(blue), display electrodes to light the cells, and address electrodes to control light emissions of the cells, the method comprising:

dividing the image display screen into display blocks, each display block corresponding to a pixel and comprising four or more of the cells having at least one of each of the R cells, the G cells, and the B cells, wherein at least two cells have the same light color;

connecting each odd address electrode to each even neighboring electrode outside the image display screen;

applying a voltage to the address electrodes connecting the cells; and switching the applied voltage to control a number of the cells that are lighted among the cells having the same light color.

15. The plasma display panel according to claim 4, wherein a width of the odd address electrodes is constant and the width of the even address electrodes is wider than the width of the odd address electrodes and wider than the width of the display electrodes only at intersections with the display electrodes.

16. A color display device, comprising:

an image display screen made of cells having light colors comprising R(red), G(green), and B(blue) and divided into display blocks, wherein each display block corresponds to a pixel and is made of tour or more cells comprising at least one of each of the R cells, G cells, and B cells, and at least two of the cells having the same light color, where the cells having the same light color in the display block have discharge spaces with dimensions different from each other.

17. The method to drive the plasma display panel according to claim 12, further comprising:

connecting each odd address electrode to each even neighboring electrode outside the image display screen so as to connect the cells having the same light color in each display block.

18. The method to drive the plasma display panel according to claim 13, further comprising:

connecting each odd address electrode to each even neighboring electrode outside the image display screen so as to connect the cells having the same light color in each display block.

19. A method to drive a plasma display panel comprising an image display screen made of cells having light colors R(red), G(green) and B(blue), comprising:

dividing the image display screen into display blocks, each display block corresponding to a pixel and including a plurality of cells having at least one of each of the R cells, the G cells, and the B cells, wherein M (two or more) cells have the same light color and respective structures partially different from each other; and applying a common voltage to the M cells to enable light emission quantity control in which light emission quantity in display block has at least (M+1) values, including a non-light value.

* * * * *

UNITED STATES PATENT AND TRADEMARK OFFICE

CERTIFICATE OF CORRECTION

PATENT NO. : 6,980,179 B2
APPLICATION NO. : 10/361502
DATED : December 27, 2005
INVENTOR(S) : Norio Yatsuda et al.

It is certified that error appears in the above-identified patent and that said Letters Patent is hereby corrected as shown below:

Title Page, Column 2 (U.S. Patent Documents), Line 1, above "6,326,981" insert -- 5,330,570 06/1996 Terumoto …… 349/106 --.

Title Page, Column 2 (Foreign Patent Documents), Line 2, delete the entire line.

Column 8, Line 46, change "cells," to --cells--

Column 8, Line 65, after "other" insert --to--.

Column 9, Line 31, after "connect" insert --the--.

Column 11, Line 11, change "tour" to --four--

Column 12, Line 19, after "in" insert --a--.

Signed and Sealed this

Eighth Day of August, 2006

JON W. DUDAS
*Director of the United States Patent and Trademark Office*